United States Patent [19]

Gibson

[11] 4,263,871

[45] Apr. 28, 1981

[54] APPARATUS FOR POWDER COATING SUCKER ROD

[76] Inventor: Jack E. Gibson, 3807 Melody La., Odessa, Tex. 79762

[21] Appl. No.: 113,916

[22] Filed: Jan. 21, 1980

Related U.S. Application Data

[63] Continuation of Ser. No. 866,884, Jan. 4, 1978, abandoned.

[51] Int. Cl.[3] ..... B05C 5/00

[52] U.S. Cl. ..... 118/310; 118/308; 118/312; 118/320; 118/DIG. 4; 118/DIG. 5; 427/195

[58] Field of Search ..... 427/32, 183, 184, 185, 427/195, 233, 295, 318, 375, 374, 298, 420, 425, 434; 128/308, 309, 310, 312, 318, 408, DIG. 5, DIG. 4

[56] References Cited

U.S. PATENT DOCUMENTS

| | | | |
|---|---|---|---|
| 2,924,911 | 2/1960 | Leliaert | 118/309 X |
| 3,070,457 | 12/1962 | Labombarde | 427/195 |
| 3,161,530 | 12/1964 | Strobel | 427/195 |
| 3,207,618 | 9/1965 | De Hart | 427/195 |
| 3,208,868 | 9/1965 | Strobel et al. | 427/195 |
| 3,257,116 | 6/1966 | Sharetts et al. | 427/185 |
| 3,416,492 | 12/1968 | Greenleaf | 118/DIG. 5 |
| 3,508,946 | 4/1970 | Plueddemann et al. | 118/308 |
| 3,560,239 | 2/1971 | Facer et al. | 427/38 |
| 3,598,626 | 8/1971 | Probst et al. | 118/309 X |
| 3,802,908 | 4/1974 | Emmons | 118/DIG. 11 |
| 4,018,185 | 4/1977 | Myers | 118/308 |
| 4,034,703 | 7/1977 | Scheiber et al. | 118/35 |

FOREIGN PATENT DOCUMENTS

| | | | |
|---|---|---|---|
| 675205 | 12/1963 | Canada | 427/374 |
| 733462 | 5/1966 | Canada | 427/195 |
| 993566 | 5/1965 | United Kingdom | 427/185 |
| 1186569 | 4/1970 | United Kingdom | 118/308 |

*Primary Examiner*—Shrive P. Beck
*Attorney, Agent, or Firm*—Marcus L. Bates

[57] ABSTRACT

Elongated members to be plastic coated are cleaned, preheated to a temperature above the melting point of powdered plastic, and axially rotated while moved through a special coating chamber. Air locks located on opposed walls of the chamber freely receive the heated rotating member therethrough. An isolated, dry fluidized bed of plastic particles is formed below the airlocks and in underlying relationship to the moving member. A conduit has an inlet thereof located within the bed and an outlet thereof is directed downwardly towards the rotating member. An air lift moves the fluidized plastic from the bed, through the conduit, and into contact with the outer surface of the heated, rotating member, whereupon some of the powdered plastic fuses into a uniform coating which adheres to the outer surface of the member. A wet quench chamber is located immediately adjacent to the dry coating chamber. Liquid coolant flows about the hot plastic coated member and reduces the temperature thereof to a value which enables the coating to become sufficiently hard for handling.

1 Claim, 7 Drawing Figures

APPARATUS FOR POWDER COATING SUCKER ROD

This is a continuation of application Ser. No. 866,884 filed 1-4-78 and now abandoned.

BACKGROUND OF THE INVENTION

Payne, U.S. Pat. No. 3,958,049; Inamura U.S. Pat. No. 3,974,306; Gibson, De Hart, U.S. Pat. No. 3,207,618; Kato, U.S. Pat. No. 3,982,050; and Stallard, U.S. Pat. No. 3,532,531 represent the most pertinent prior art respective to this invention. Payne cleaned, inspected, and coated sucker rod using metallic spray and sometimes a resin top coat. The other cited patents relate to coating the interior of tubular goods by the use of fluidized beds. However, no one has heretofore suggested flowing a fluidized bed directly onto the heated exterior of a member, such as a sucker rod or pipe or the like, and immediately thereafter quenching the member by directly flowing a liquid coolant onto the hot fused plastic coating while the coating is in the plastic state. Reference is made to the above cited art for further background of this invention.

SUMMARY OF THE INVENTION

Method and apparatus for powder coating an elongated member, such as pipe or sucker rod, to provide a uniform, continuous plastic coating on the exterior thereof. The method is carried out by preheating cleaned members to a temperature above the melting point of the plastic and rotating the member about its longitudinal axis as it is moved longitudinally respective to a fixed nozzle through which fluidized plastic flows. The fluidized plastic flows about the rotating, heated member, and part of the powdered plastic is fused into a continuous uniform coating. The member is immediately thereafter quenched by flowing a liquid coolant into intimate contact with the coated member while the coating is in the plastic stage. The coolant reduces the temperature of the coating to a value which is sufficiently hard to enable handling of the member.

More specifically, the method is carried out in accordance with this invention by the provision of a chamber having a fluidized bed contained therein. A conduit has the inlet end thereof located within the bed. The outlet of the conduit is placed respective to the rotating heated member so that fluidized plastic powder flows from the bed, through the conduit, and exits the nozzle where it forms a bath about the member. An air lift is employed to force the fluidized plastic to move through the conduit and onto the outer rotating surface of the member.

A liquid coolant intimately contacts the member immediately following the coating step to "set" the plastic coating so that the member can be subsequently handled without injurying the coating.

Both the coating chamber and the cooling chamber have spaced air locks which are aligned with and freely receive the member therethrough, thereby maintaining the marginal length of the member which is undergoing treatment to be freely suspended where no damage can occur to the plastic coating during the process.

Accordingly, a primary object of the invention is the provision of a method and apparatus by which the outside surface of elongated solid or hollow members can be plastic coated by utilizing powdered plastic.

Another object of the invention is to provide method and apparatus by which a heated member can be imparted with a uniform plastic coating.

A further object of this invention is to disclose and provide a method by which powdered plastic is fused to the outside surface of a heated member and immediately thereafter quenched to enable subsequent handling.

A still further object of this invention is the provision of both method and apparatus by which plastic powder is fused to a heated member and immediately thereafter the member is contacted with a liquid coolant which rapidly reduces the temperature of the coating below the melting point thereof.

Another and still further object of this invention is to provide method and apparatus by which a marginal length of a heated, rotating, elongated member is freely supported to enable powdered plastic to be fused thereto and thereafter cooled as the member continuously moves during the coating process.

An additional object of the present invention is the provision of method and apparatus by which a rotating heated member is moved longitudinally, while a marginal length thereof is contacted with plastic powder and coated, while another marginal length thereof is simultaneously cooled below the fusion temperature of the plastic to thereby enable the member to be processed in a single operation.

These and various other objects and advantages of the invention will become readily apparent to those skilled in the art upon reading the following detailed description and claims and by referring to the accompanying drawings.

The above objects are attained in accordance with the present invention by the provision of a method of powder coating the exterior of elongated members with plastic for use with apparatus fabricated in a manner substantially as described in the above abstract and summary.

DETAILED DESCRIPTION OF THE PREFERRED EMBODIMENT

Figure 1:
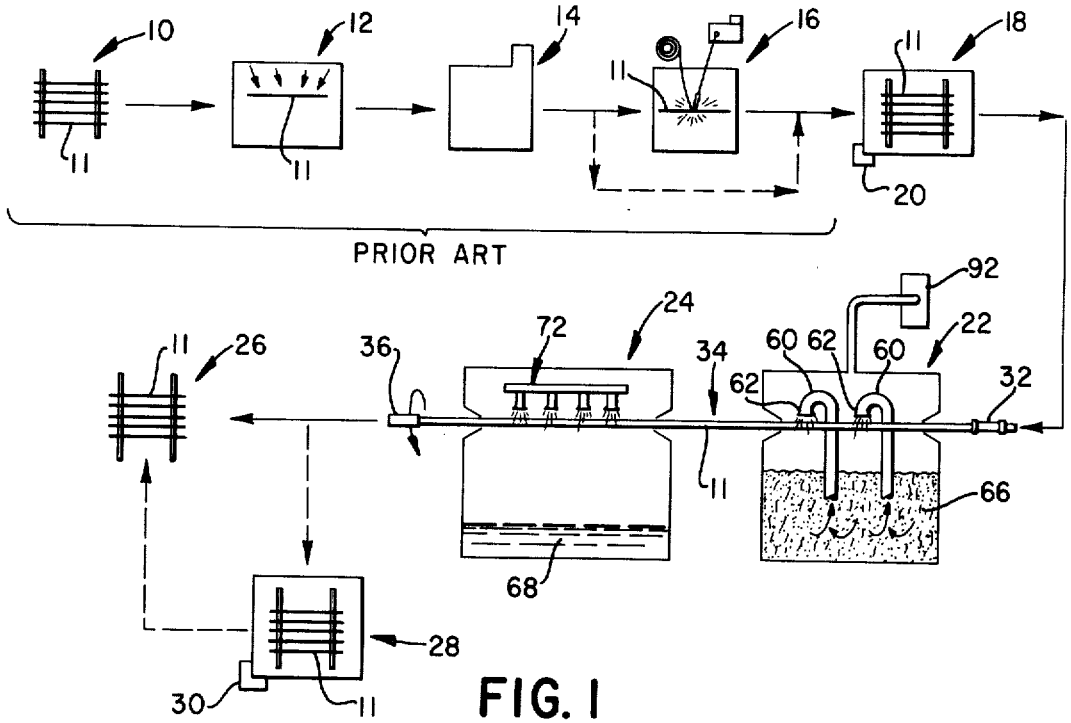
FIG. 1 is a schematical representation of a flow sheet which sets forth a process according to the present invention.

In FIG. 1 there is diagrammatically disclosed a pipe rack 10 upon which a plurality of sucker rods 11 are stored. The rods are solid in cross-section and constitute an elongated member. According to this disclosure, pipe and other tubular members of cylindrical and polygonal cross-sectional configuration also are encompassed by the term "elongated member". The rod is cleaned at 12, inspected at 14, and metal coated at 16, preferably according to U.S. Pat. No. 3,958,049, issued to Bobby L. Payne. Therefore, this part of the apparatus is noted in the drawing as belonging to the prior art. Other means can, of course, be employed to clean the member 11, and it is unnecessary to metal coat the rod at 16 in order to carry out the present invention.

The instant invention therefore commences with clean elongated members 11 which are preheated in oven 18. Burner 20 controls the temperature within the oven. The heated members are removed from the preheat oven and moved along its longitudinal axis through the apertured housings 22 and 24 for the purpose of coating the exterior surface thereof with a uniform layer of plastic material.

As seen in FIG. 1, the processed members which have proceeded through the treatment stations 22 and 24 are racked at 26, or alternatively, the members may first be subjected to another soaking or heating period within a second oven 28. Oven 28 has a burner 30 for controlling the temperature therein in the same manner of the first oven and burner. The members are transferred from the second oven, cooled, and stored on rack 26 after the desired residence within the second oven.

Numeral 32 indicates a trailing end of member 11; numeral 34 a marginal length thereof and also a visual inspection station; while numeral 36 indicates the leading end of the member. As seen in FIG. 1, the member is rotated about its longitudinal axial centerline as it moves longitudinally through the coating and quenching stations.

Figure 2:
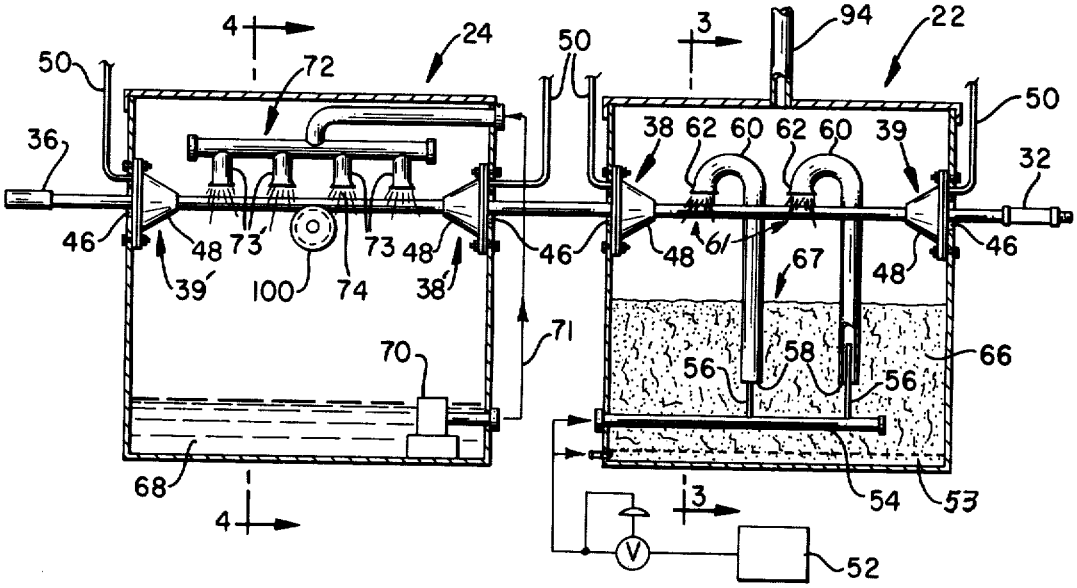
FIG. 2 is an enlarged, part cross-sectional view of part of the apparatus disclosed in FIG. 1.
Figure 3:
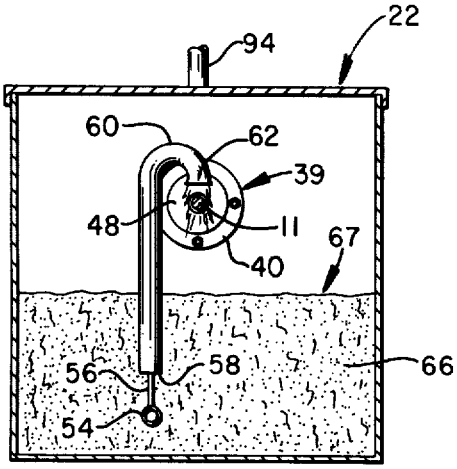
FIG. 3 is a cross-sectional view taken along line 3—3 of FIG. 2.
Figure 4:
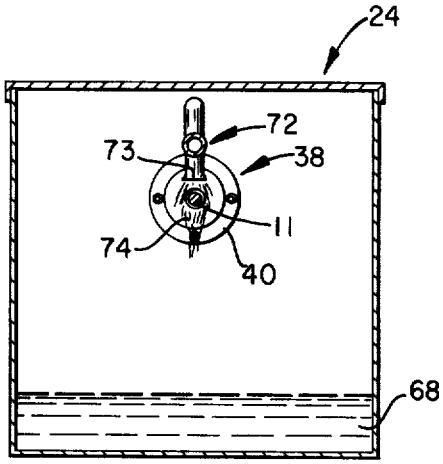
FIG. 4 is a cross-sectional view taken along line 4—4 of FIG. 2.

In FIG. 2, the apertured opposed walls of the powder applying housing 22 and quench housing 24 are provided with spaced, axially aligned, opposed air locks 38 and 39 which freely receive the rotating member in spaced, axially aligned relationship therethrough. As seen in FIGS. 2–6, the air locks may be identical with one another. The locks each include a mounting flange 40 upon which a bolt circle 42 is formed by which the flange can be mounted to a wall 44 of the housing, for example. Each of the opposed walls are apertured as seen at 46 to form a generous annulus between the member 11 and the inner peripheral edge of the aperture, so that the member 11 avoids contact therewith. Each air lock includes the illustrated conical wall which inwardly tapers towards one another and terminates at 48 to present a frustum of a cone.

Air supply pipe 50 is connected to flange 40 and to a supply of air 52 when the apparatus is in operation. Air supply 52 also provides a regulated flow of air to the manifold 54. Branch lines 56 have the marginal free ends thereof extended axially into the marginal lower free ends of conduits 58. The conduits have a lower open end thereof located within the illustrated fluidized bed 66. Numeral 53 schematically suggests means forming a fluidized bed 66 within container 22. The details of achieving a fluidized bed at 66 are well known and amply taught in my copending patent application Ser. No. 704,965 and in the art cited therein. The marginal end at 62 is bent into a goose-neck at 60. The outlet end 62 of the conduits are directed towards the exterior surface of member 11 so that flow of plastic material from the bed onto the outer surface of the member can be achieved in the most desirable manner. The upper surface 67 of the bed underlies the member 11 and the air locks 38, 39.

The bottom of the quench chamber 24 is provided with an ample water supply 68. Submersible pump 70 lifts the water through conduit 71 to provide a low pressure source of coolant at manifold 72. A plurality of flow nozzles 73 are parallel connected to the manifold and aligned in spaced, superimposed relationship respective to member 11 so as to provide a quiescent but fast flow of liquid coolant which flows with sufficient velocity and in sufficient quantity to entirely cover or wet a substantial marginal length of the member with a blanket of water, as noted at 74.

Figure 5:
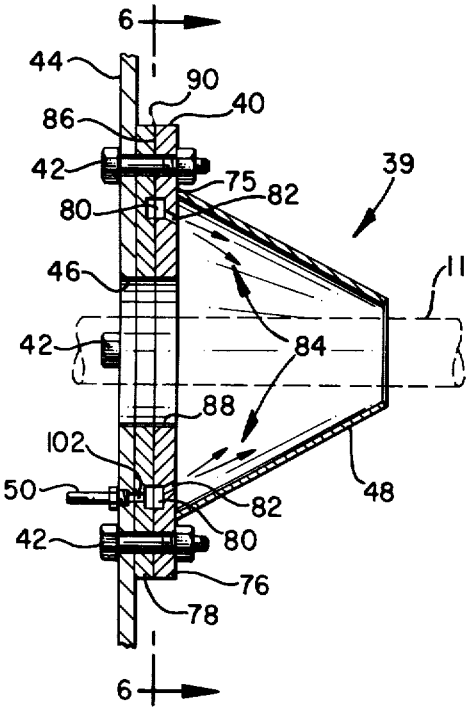
FIG. 5 is an enlarged, fragmented, cross-sectional, detailed view of part of the apparatus disclosed in FIGS. 1-4.
Figure 6:
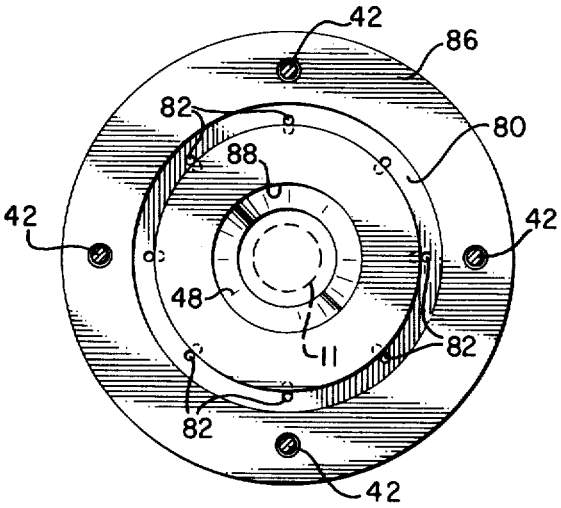
FIG. 6 is an opposed isolated end view of the apparatus disclosed in FIG. 5; and, FIG. 7 is a cross-sectional view of a member processed in accordance with this invention.

In FIGS. 5 and 6, wherein the air locks are shown in greater detail, the cone section is affixed to the flange at 75. The flange is made of two members 76 and 78 which are grooved to mutually form an annular air chamber 80. A plurality of radial ports 82 open towards the inside conical surface of the truncated cone to provide an air flow for substantially 360° as indicated at 84. The face 86 of the flanges receive the before mentioned bolt circle. The central aperture 88 coincides with the apertures formed within the housing wall 44. Numeral 90 indicates the interface formed between the abutting flange members 76 and 78. Air supply passageway 102 leads to annulus 80.

Figure 7:
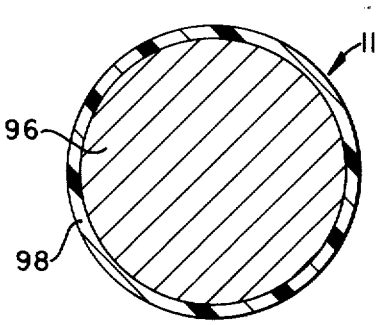

In FIG. 7, the processed elongated member is seen to be circular in cross section and is made of solid metal 96. A plastic coating 98 has been fused to the exterior surface of the member according to the present invention.

In operation, cleaned sucker rod enters the opposed apertures of the airlocks of the coating chamber 22 and continues longitudinally therethrough and through the opposed apertures ofthe quench chamber 24. The apertures and airlocks are each axially aligned respective to one another and the rod is supported by a plurality of rollers, one of which is seen at 100 in FIG. 2, such that the marginal length of the rod located between roller 100 and the entrance 46 of the dry powder chamber is maintained free from contacting any support means, or otherwise the plastic coating will be injured.

The rod spins at about 100 rpm and moves longitudinally at 0.14 feet per second. One suitable powdered plastic used at 66 is Corvel Polymer ECA-1446 Tan 2818 Epoxy and is available from Corvel Corporation. Other types of powdered plastic can also be used in conjunction with this invention.

An air supply 52 continually moves fluidized plastic powder up through the paint conduits 60, which curve back into overlying relationship respective to the rod 11 so that the rod is continually bathed in a smooth flow of fluidized plastic powder. The rotating, heated, longitudinally moving rod melts or fuses the plastic to the outer surface thereof as the rod moves through the elevated fluidized powder bath.

The use of two conduits 60, 62 of ¾ inches i.d., a tube 56 of 1/16 inches i.d., and a regulated air pressure at 54 of 20 psig provides a plastic coating of 12 mills on a one inch o.d. sucker rod. The rod is rotated at 100 rpm and moved 0.14 feet/second through the fluidized powder bath. Preheat temperature is about 400° to provide a rod temperature of about 320° F. at 22.

As previously noted, the rod preferably is supported at a plurality of locations such that as the marginal length thereof passes through the four airlocks it remains axially aligned; however, there must be no support between the initial quench (roller 100) and the powder application (at 39). The roller 100 does not injure the coating because the newly applied coating is completely covered with flowing water and its temperature has been reduced to a value which hardens the plastic sufficiently for handling. However, at location 100, the interior mass of the rod contains sufficient residual heat to subsequently soften the outer plastic coating at a location downstream of the roller 100 (i.e. after a short time interval); and therefore, additional quenching at 73' is required to further reduce the overall heat content or temperature of the rod.

Stated differently, the small amount of air cooling which occurs at 34 is insufficient to reduce the temperature of the coating below its fusion temperature. The first two quench nozzles 73 momentarily reduce the temperature of the outer coat so that the rod supportingly rides the roller 100 with no injury thereto. Additional quench 73' is required in order to further lower the heat content of the rod to a value which results in a final overall temperature which is below the softening temperature of the plastic. Otherwise, the rod could not be subsequently handled as it emerges from the quench chamber without damaging the coating. Accordingly, in the absence of the additional quench at 73', the residual temperature of the rod will remelt the coating and cause damage thereto.

The rod is rotated throughout the coating application process so that the film or coating cannot gravitate downward, which would result in uneven thickness about its outer periphery. The coating chamber 22 and quench chamber 24 could share a common wall, thereby eliminating one airlock 38' or 48; however, it is preferred to separate the coating and quench stations so as to provide for the before mentioned air cooling and visual inspection of the melted plastic coating, as well as to enhance ease of maintenance of the apparatus. The two stations may be placed about eight to fourteen inches apart at 34. Hence, the time interval between coating and quench is very short.

The airlocks provide a slightly increased pressure gradient within the cone causing flow at 84 to occur both inwardly into the container and outwardly to the atmosphere so that no powder is lost and the rod emerges from 24 substantially free of water. Pipe 94 of FIG. 3 leads to a small cyclone separator 92 with separated powder being returned to the bed 66 manually.

The present invention provides a flowing bath of fluidized plastic particles at 61 which completely envelopes the heated, rotating, longitudinally moving rod for a marginal length thereof, so that the plastic particles immediately adjacent to the rod surface are melted into a continuous coating. The temperature of the rod, rate of rotation, longitudinal rate of travel, and length and concentration of the powder bath all contribute to determine the coating thickness.

Simultaneously with the coating step, or continuously therewith and spaced therefrom, is the quenching step wherein the temperature of the rod is reduced to a value which is below the melting point of the plastic coating.

The provision of a fluidized bath which completely envelopes the heated rotating rod provides an unusual and unexpected coating which is superior to other known coatings, and which enables very close control of the uniformity and thickness thereof.

The successful employment of direct water quench or bath on the melted plastic provides unexpected results. The coating is not injured by the blanket of cascading water but instead results in a beautiful, smooth, desirable finish which is attractive and has excellent physical properties. The liquid quench almost instantaneously reduces the temperature of the plastic so that it can be almost immediately supported at 100. Additional rollers are employed upstream of the process near 32 and downstream of the process near 36 so as to maintain proper alignment of the rod. The rod can be immediately racked at 26 or, where required, imparted with additional heat treatment at 28 before it is stored for use at 26.

I claim:

1. An apparatus by which a rod can be powder coated with plastic comprising:

a heating chamber means, a powder coating chamber means, and a liquid contact cooling chamber means; all of which cooperate together to enable the rod to be heated above the fusion point of the plastic material, then coated with the plastic material, and there after cooled to a temperature below the fusion temperature of plastic material; means for rotating said rod and means for transporting said rotating rod from said heated chamber means, through said powder coating chamber means, and through said cooling chamber means;

said powder coating chamber consisting of a lower portion, a top portion in communication with said lower portion, opposed walls, means forming a fluidized bed in the lower portion thereof in spaced relationship to the top portion, and apertures formed in the opposed walls of said chamber at a location above said lower portion containing the fluidized bed so that a heated rod can freely extend through the apertures, said apertures having air seals to isolate the interior of the coating chamber from the ambient;

airlift means located within said powder coating chamber for lifting fluidized powder from the bed up into the top portion of the coating chamber into overlying relationship respective to the heated rod passing through the coating chamber so that a length of the rod is blanketed with plastic particles which fuses some of the particles of the blanket to the exterior of the heated rod and some of the particles are returned directly to the bed;

said airlift means consisting of a plurality of conduits having a lower open inlet end located within the fluidized bed said conduits extending out of said bed and above said rod, the portion of said conduit extending above said rod terminating over said rod in a goose-neck, and an air nozzle located within said inlet for flowing the fluidized particles up and through said conduits.

* * * * *